US010576504B2

(12) United States Patent
Meranda

(10) Patent No.: US 10,576,504 B2
(45) Date of Patent: Mar. 3, 2020

(54) GYRATORY SIFTER SIDE FINES CHUTES

(71) Applicant: M-I L.L.C., Houston, TX (US)

(72) Inventor: Christopher Meranda, Union, KY (US)

(73) Assignee: M-I L.L.C., Houston, TX (US)

( * ) Notice: Subject to any disclaimer, the term of this patent is extended or adjusted under 35 U.S.C. 154(b) by 0 days.

(21) Appl. No.: 16/078,632

(22) PCT Filed: Apr. 26, 2017

(86) PCT No.: PCT/US2017/029495

§ 371 (c)(1),
(2) Date: Aug. 21, 2018

(87) PCT Pub. No.: WO2017/192315

PCT Pub. Date: Nov. 9, 2017

(65) Prior Publication Data

US 2019/0047022 A1 Feb. 14, 2019

Related U.S. Application Data

(60) Provisional application No. 62/331,333, filed on May 3, 2016.

(51) Int. Cl.

| | |
|---|---|
| ***B07B 13/16*** | (2006.01) |
| ***B07B 1/28*** | (2006.01) |
| ***B07B 1/42*** | (2006.01) |

(52) U.S. Cl.

CPC ..... *B07B 13/16* (2013.01); *B07B 1/28* (2013.01); *B07B 1/42* (2013.01); *B07B 2201/04* (2013.01)

(58) Field of Classification Search

CPC ..... B07B 1/28; B07B 13/16; B07B 2201/04
USPC ..... 209/255
See application file for complete search history.

(56) References Cited

U.S. PATENT DOCUMENTS

| | | | | |
|---|---|---|---|---|
| 3,380,100 A * | 4/1968 | Pharris | B44D 3/126 | 15/257.06 |
| 4,576,713 A * | 3/1986 | Melin | B07B 1/46 | 137/561 A |
| 6,575,304 B2 * | 6/2003 | Cudahy | B07B 1/005 | 209/315 |

(Continued)

OTHER PUBLICATIONS

International Search Report and Written Opinion for the equivalent International patent application PCT/US2017/029495 dated Aug. 3, 2017.

(Continued)

*Primary Examiner* — Terrell H Matthews
(74) *Attorney, Agent, or Firm* — Jeffrey D. Frantz

(57) ABSTRACT

An apparatus includes a first fines pan side traversing from a feed end to a discharge end, a second fines pan side traversing from the feed end to the discharge end opposite the first fines side, a first surface traversing from the first fines pan side upwards towards an apex of the fines pan, and a second surface traversing from the second fines pan side upwards towards the apex of the fines pan, the first fines pan side, the second fines pan side, the first surface, and the second surface forming a fines pan. The first fines side having a first fines opening proximate the discharge end. The second fines side having a second fines opening proximate the discharge end.

17 Claims, 8 Drawing Sheets

(56) References Cited

U.S. PATENT DOCUMENTS

| | | | | |
|---|---|---|---|---|
| 2011/0186484 | A1* | 8/2011 | Heitfeld | B07B 1/38 209/309 |
| 2011/0314652 | A1* | 12/2011 | Ballman | B07B 1/46 29/428 |
| 2012/0145608 | A1* | 6/2012 | Garland | B07B 1/005 209/659 |
| 2013/0037455 | A1* | 2/2013 | Irwin | B07B 1/28 209/257 |
| 2014/0061140 | A1* | 3/2014 | Bailey | B07B 1/46 210/780 |

OTHER PUBLICATIONS

International Preliminary Report on Patentability for the equivalent International patent application PCT/US2017/029495 dated Nov. 15, 2018.

Office Action for the equivalent German patent application 112017002332.7 dated Mar. 25, 2019 including machine translation into English.

Examination Report for the equivalent Canadian patent application 3022701 dated Oct. 8, 2019.

* cited by examiner

GYRATORY SIFTER SIDE FINES CHUTES

CROSS-REFERENCE TO RELATED APPLICATION

The present application claims priority to U.S. Application Ser. No. 62/331,333, filed May 3, 2016, which is incorporated herein by reference in its entirety

BACKGROUND

Sifters and vibratory separators are used in a variety of applications for separating materials by size. For example, sifters and vibratory separators may be used to separate sized particles or to separate solids from liquids. These devices may be used to screen materials in various industries for industrial sorting, manufacturing operations, oil and gas drilling and production operations, etc.

Gyratory sifters are used in a variety of applications for separating solids by size. These applications include separating particles of sugar, flour, sand and various chemical powders. Gyratory sifters may be used for both wet and dry screening. Gyratory sifters include screens or perforated plates oriented generally horizontally, sloping from the head end (feed end) to the tail end (discharge end) of the sifter. The screens may be disposed in a screen basket. The screen basket may be suspended by a set of hangers that allow the basket to move on a horizontal plane. An eccentric drive mechanism, e.g., a belt driven eccentric weight, or other motive force is coupled to the screen basket to provide a circular motion substantially in a horizontal plane.

Generally, sifters include a class of vibratory devices used to separate sized particles, as well as to separate solids from liquids. Sifters are used to screen, for example, feed material, plastic resins, and powders during industrial sorting and/or manufacturing operations. Screens of sifterm include a perforated plate base or a ballbox upon which a wire mesh, or other perforated filter overlay, is positioned. The perforated plate base or ballbox generally provides structural support and allows the passage of fluids or sized material therethrough, while the wire mesh overlay defines the largest solid particle capable of passing therethrough.

Beneath the screens is a fines pan which collects fines. Fines are the sized material which has passed through the filter screen. The fines are discharged out the discharge end of the sifter alongside, but separated from, the product. Multiple cut machines have decks in series or parallel. Screens used with sifters are placed in a generally horizontal fashion on a substantially horizontal bed or support structure located within a basket in the sifter. The screens themselves may be flat, nearly flat, corrugated, depressed, and/or contain raised surfaces. The basket in which the screens are mounted may be inclined towards a discharge end of the sifter. The sifter imparts a rapidly reciprocating motion to the basket and the screens. A source material, from which particles are to be separated, is poured onto a back end of the screen. The material generally flows toward the discharge end of the basket. Large particles that are unable to pass through the screen remain on top of the screen, and move toward the discharge end of the basket where they are collected. Smaller particles and/or fluid pass through the screen and collect in a bed, receptacle, or pan therebeneath.

The frame of the sifter or screen basket is resiliently suspended or mounted upon a support. A circular or elliptical motion is imparted to the screen basket by rotating an unbalanced weight about a drive shaft connected to the frame.

DETAILED DESCRIPTION

Generally, embodiments disclosed herein relate to fines pans for gyratory sifters. More specifically, embodiments disclosed herein relate to fines pans for gyratory sifters having one or more side chutes. More specifically still, embodiments disclosed herein relate to apparatuses and methods for using gyratory sifters that include fines pans and side chutes.

Embodiments disclosed herein pertain to construction of fines pans used in gyratory sifters; particularly the method used to discharge or remove the fines product from the sifter. In accordance with embodiments disclosed herein, the fines product from each deck is recombined and collected prior to the fines reaching a discharge conduit at the discharge end of the sifter. Thus, embodiments disclosed herein provide a configuration of fines pans and fines chutes to simplify a door configuration of a sifter, i.e., the discharge conduits of the separated solids, and to better manage individual fines discharges.

As discussed above, gyratory sifters are used in a variety of applications for separating solids by size. These applications include separating particles of sugar, flour, sand and various chemical powders. A gyratory sifter in accordance with embodiments disclosed herein includes one or more screen assemblies having ballbox(es) or perforated plate(s) with a screening material thereon. The screening assemblies are oriented generally horizontally, sloping from the head to the tail end of the sifter. An eccentric drive mechanism or other motive force may be used to provide a circular motion substantially to the sifter in a horizontal plane.

Figure 1:
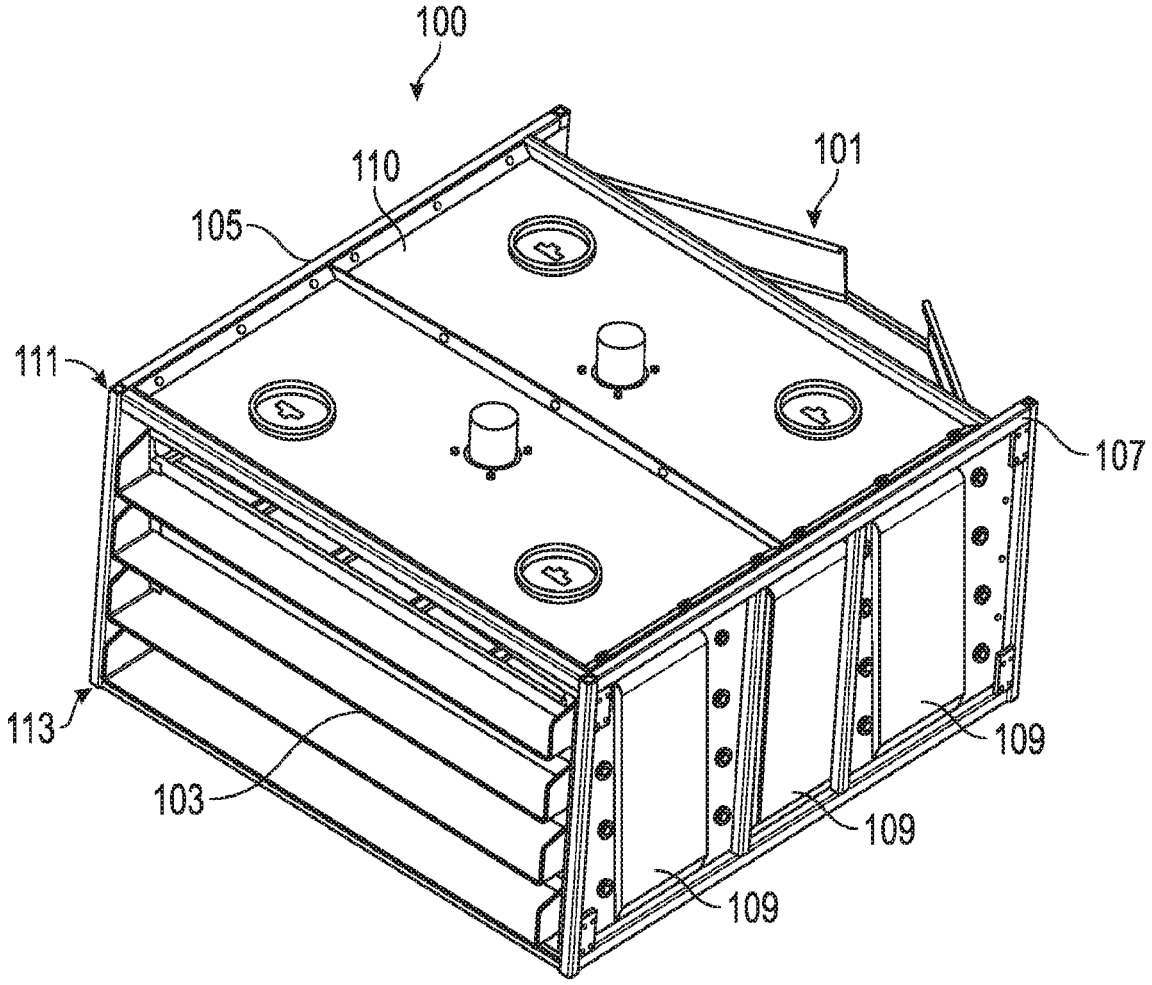
FIG. 1 shows a perspective view of a basket assembly for use in a gyratory shaker according to embodiments of the present disclosure.
Figure 2A:
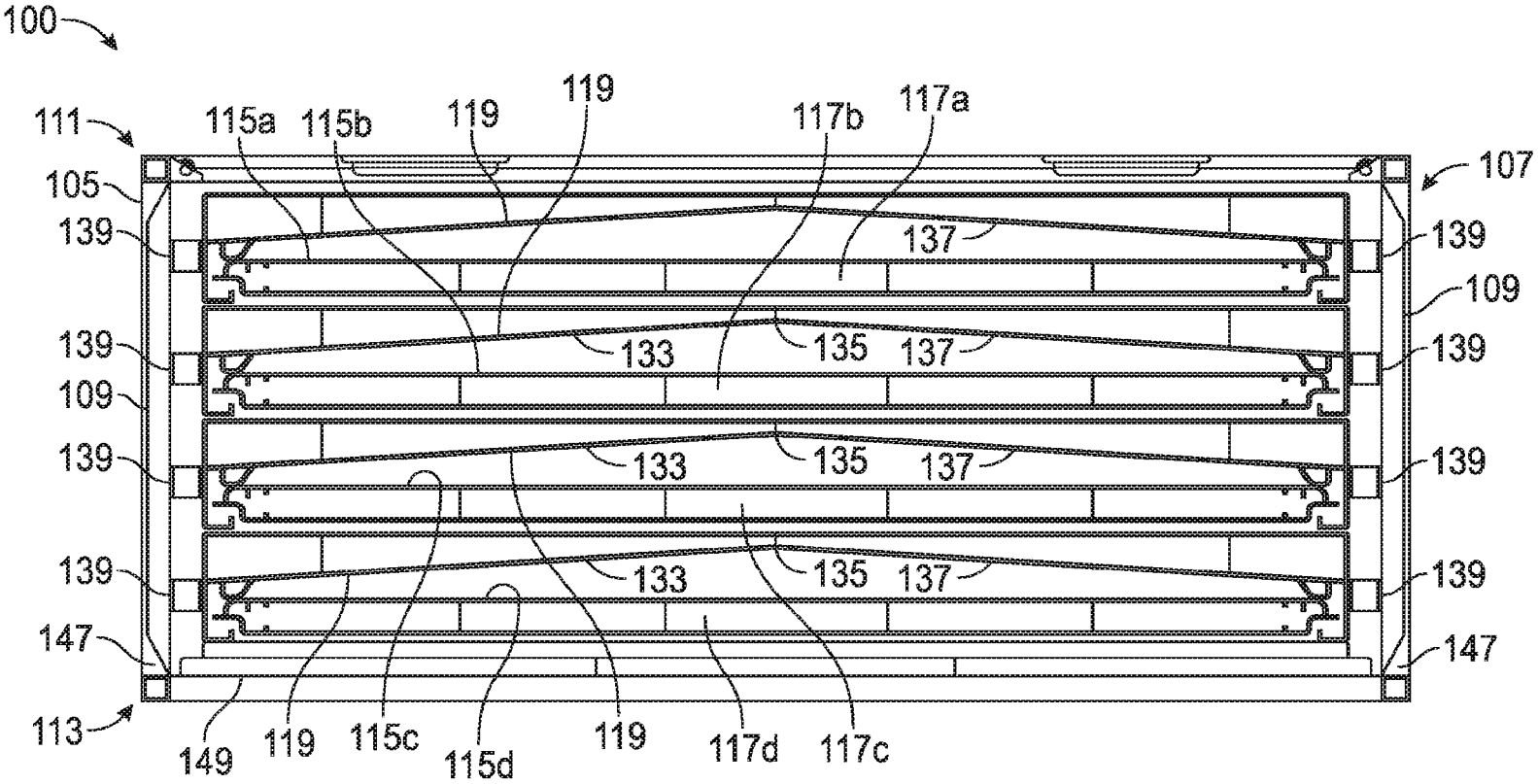
FIG. 2A shows a cross-sectional view of a discharge end of the basket assembly of FIG. 1 according to embodiments of the present disclosure.
Figure 2B:
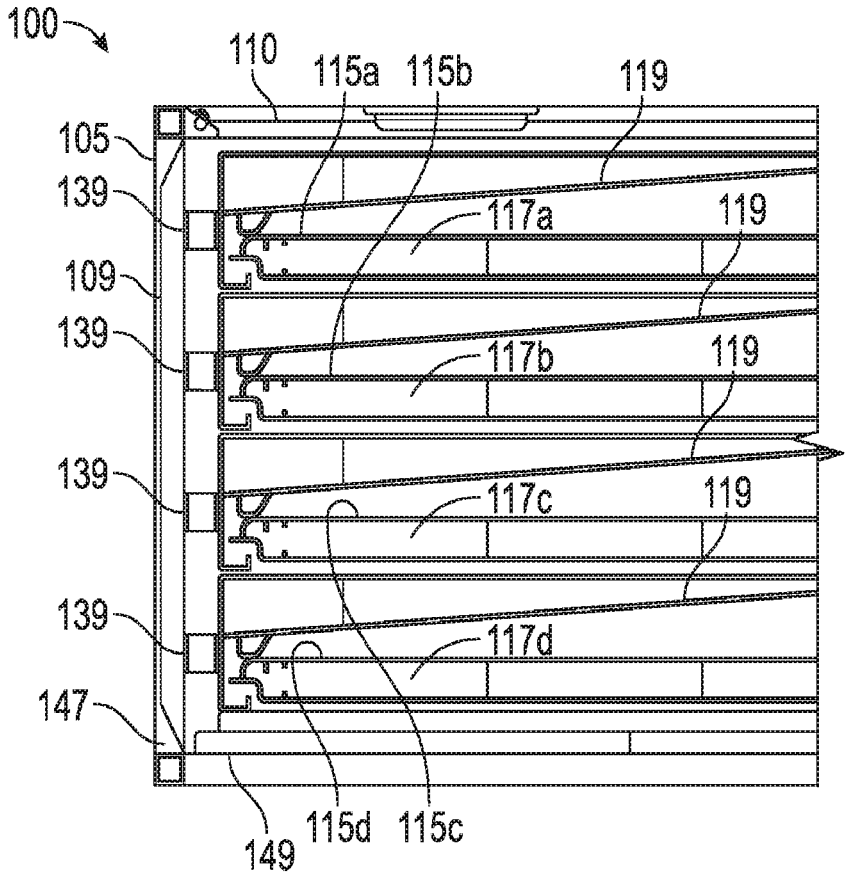
FIG. 2B shows a detailed view of the discharge end of the cross-sectional view of the basket assembly of FIG. 2A.

Referring initially to FIG. 1, in which a perspective view of a basket assembly 100 according to embodiments of the present disclosure is shown, and FIGS. 2A and 2B, in which cross-sectional views of the basket assembly 100 according to embodiments of the present disclosure are shown, a gyratory sifter includes a basket assembly 100. In this embodiment, the basket assembly includes a feed end 101, a discharge end 103 opposite the feed end 101, a first side 105 traversing from the feed end 101 to the discharge end 103, and a second side 107 side traversing from the feed end 101 to the discharge end 103 and opposite the first side 105. In some embodiments, the basket assembly 100 has a top cover 110. Located within the basket assembly 100 is at least one screen 115 designed to allow particles with generally smaller diameters than openings in the screen to pass through the screen, while larger particles remain above the screen 115. In some embodiments, there may be multiple levels of screens 115 spaced apart (uniformly or non-uniformly) from a top end 111 to a bottom end 113. One of ordinary skill in the art will appreciate that the basket assembly 115 may include one, two, three, or more levels of screens to achieve a desired separation of the solids particles for a given application. In some embodiments, each level of screen 115 may include a series of screens 115 traversing the length of the basket assembly 100. One of ordinary skill in the art will appreciate that the number of screens on each level may be one, two, or more. In some embodiments, the levels of screens 115 may be fed in series. In other embodiments, the flow of material across the levels of screens 115 may be in parallel.

Located below the at least one screen 115 is at least one ballbox 117. Ballboxes 117 include ballbox screens which typically have significantly larger openings than the screens 115 and are configured to support the screen 115 (e.g., screen mesh) to allow particles that pass through the screens 115 to freely pass through the holes in ballbox screen. In some embodiments, the number of ballboxes 117 correspond to the number of screens 115 in the basket assembly 100. The ballboxes 117 may include a plurality of balls, made from, for example, an elastomer material, that move within the ballboxes 117 and may contact a bottom surface of the screen 115 to increase separation of materials through the screen 115 and decrease blinding of the screen 115. In accordance with one or more embodiments, the screen 115 may be tensioned across the ballbox 117.

In some embodiments, the basket assembly 100 includes at least one side chute 109 on the first side 105, the second side 107, or both sides. In one embodiment, the at least one side chute 109 traverses from the top end 111 to the bottom end 113 of the first side 105, the second side 107, or both sides. In other embodiments, the at least one side chute 109 extends vertically along a portion of the first side 105, the second side 107, or both sides. A height of one or more side chutes 109 may correspond to a distance between fines pans disposed below the ballboxes 117, as discussed in more detail below. In some embodiments, both the first side 105 and the second side 107 includes three side chutes 109. Each side 105, 107 includes a first chute located proximate a feed end 101 of the basket assembly 100, a second chute located proximate a center (longitudinally) of the first and second sides 105, 107, and a third chute located proximate a discharge end 103 of the basket assembly 100. In other embodiments, one or both sides 105, 107 may include two chutes 109 located proximate at least one of the feed end 101, the discharge end 103, and/or the longitudinal center of the first and second sides 105, 107.

Figure 3:
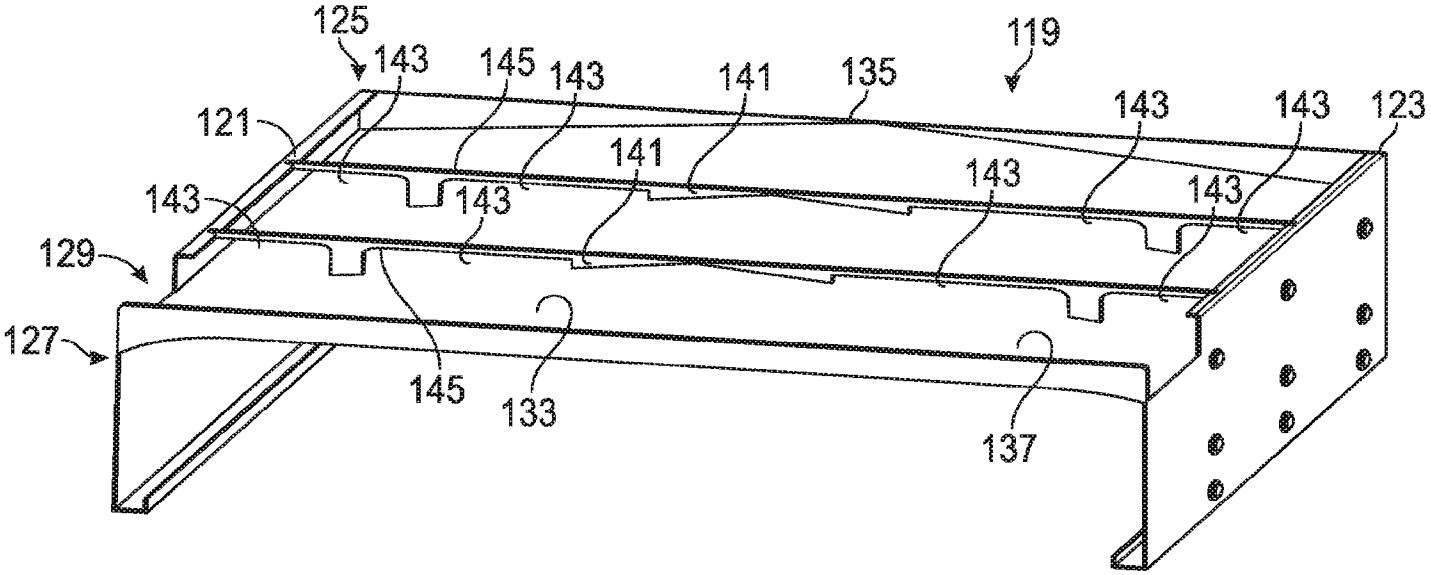
FIG. 3 shows a perspective view of a fines pan for use in a gyratory sifter according to embodiments of the present disclosure.

Referring now to FIGS. 2A, 2B, and 3, at least one angled fines pan 119 may be located beneath the at least one ballbox 117. The angled fines pan 119 may include a first fines pan side 121 traversing from a feed end 125 to a discharge end 127. The first fines pan side 121 may include a first fines pan opening 129 proximate the discharge end 127. The angled fines pan 119 may also include a second fines pan side 123 traversing from the feed end 125 to the discharge end 127 opposite the first fines pan side 121. The second fines pan side 123 may also include a second fines pan opening 131 proximate the discharge end 129. The first fines pan opening 129 and the second fines pan opening 131 extend or open laterally through the first and second fines pan sides 121, 123. In some embodiments, a first surface 133 of the fines pan 119 traverses from the first fines pan side 121 upwards towards an apex 135 of the fines pan 119. A second surface 137 may traverse from the second fines pan side 123 upwards towards the apex 135 of the fines pan 119. In accordance with embodiments disclosed herein, the apex 135 may coincide with a lateral center of the fines pan 119, such that the apex extends from the feed end 125 to the discharge end 127.

In some embodiments, the angled fines pan 119 may include one or more dividers 141 (or brackets) extending across a width of the angled fines pan 119. The dividers 141 may have a top horizontal surface 145 and one or more openings 143 therethrough to provide a flow of the materials/fines through the dividers 141.

The angled fines pan 119 may be supported in the basket assembly 100 by a plurality of spacers 139. The plurality of spacers 139 may couple the first fines pan side 121 to the first side 105 of the basket assembly 100 and may couple the second fines pan side 123 to the second side 107 of the basket assembly 100. The spacers 139 provide a path for the fines to travel from the angled fines pan 119 to the side chutes 109.

In some embodiments, the number of angled fines pan 119 may correspond to the number of screens 115 traversing the length of the basket assembly 100. In some embodiments, the first fines pan opening 129 of the angled fines pans 119 may align with a first side chute 109 on the first side 105 of the basket assembly 100 and the second fines pan opening 131 of the angled fines pans 119 may align with a second side chute 109 on the second side 107 of the basket assembly 100. For example, as shown in FIG. 1, there are three side chutes 109 corresponding to second fines pan openings 131 of the three angled fines pans 119 (FIG. 2A) traversing the length of the basket assembly 100.

Figure 6:
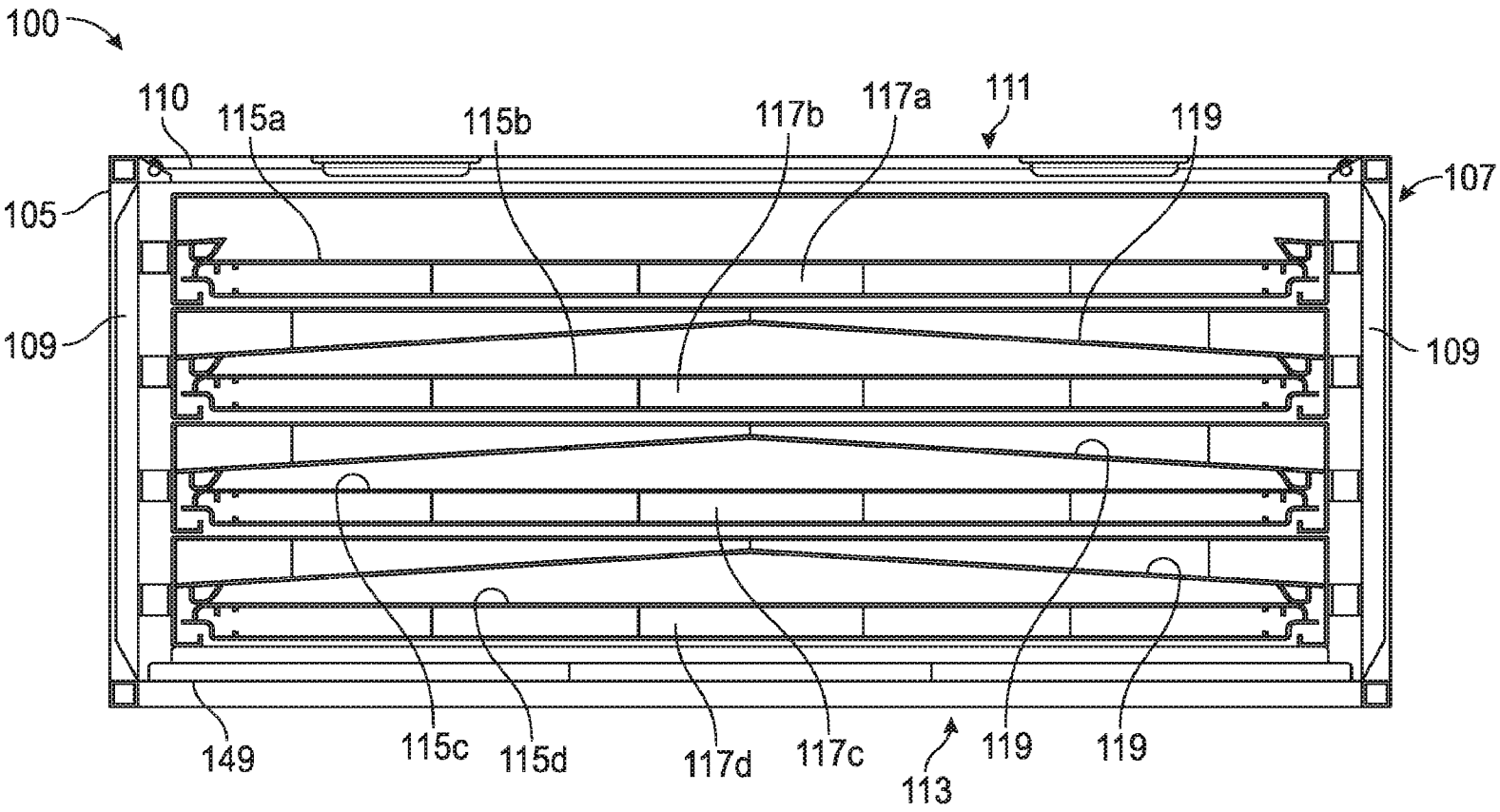
FIG. 6 shows an alternate cross-sectional view of a discharge end of the basket assembly of FIG. 1 according to embodiments of the present disclosure.

Referring to FIGS. 2A and 2B, the basket assembly 100 may include four levels of screens 115 equally spaced from the top end 111 to the bottom end 113. In some embodiments, an angled fines pan 119 may also be located above a first screen 115*a* but may or may not be in use. In other embodiments, as shown in FIG. 6, there is no angled fines pan 119 above the first screen 115*a*. In some embodiments, a bottoms fines pan 149 may be located underneath a bottom screen 115*d* and a bottom ballbox 117*d*. The bottoms fines pan 149 may be angled downwardly from the feed side 101 to the discharge side 103, such that at least a portion of the fines may be collected from beneath the screens 115*a*-155*d* and directed to the discharge side 103 by the bottoms fines pan 149 for removal from the basket assembly 100.

Fines collected in each of the angled fines pans 119 may be moved (due to the gyratory motion imparted by a drive system and the general downward angle of the sifter from the feed end to the discharge end) toward one or more side pan openings 129, 131 and therefore one or more side chutes 109 and a discharge end of the angled fines pans 119. In some embodiments, the side chute 109 may have an angled bottom surface 147 which would direct the fines which have entered the side chute 109 from the at least one angled fines pan 119 to the bottom fines pan 149.

Referring to FIGS. 1, 2A and 2B, when the basket assembly 100 is in operation within a sifter, a source material is fed to the feed end 101 and distributed to one or more screens 115*a-d*. The sifter imparts a rapidly reciprocating motion to the basket assembly 100 and the screens 115*a-d*. The source material generally flows toward the discharge end 103 of the basket assembly 100. Large particles that are unable to pass through the screens 115*a-d* remain on top of the screen, and move toward the discharge end 103 of the basket assembly where they may be collected. Smaller particles (fines) and/or fluid pass through the screens 115*a-d* and the ballboxes 117*a-d* and collect in the angled fines pans 119 therebeneath. The reciprocating motion to the basket assembly 100 and the angled fines pans 119 move the fines towards the first fines pan opening 129 and the second fines pan opening 131. The fines leave the angled fines pans 119 and enter the side chutes 109 to be collected on the bottom fines pan 149 and discharged therefrom. In some embodiments, the source material flows in a longitudinal direction through the basket assembly. In some embodiments, the fines flow in both a longitudinal direction and a lateral direction through the basket assembly 100.

Figure 4:
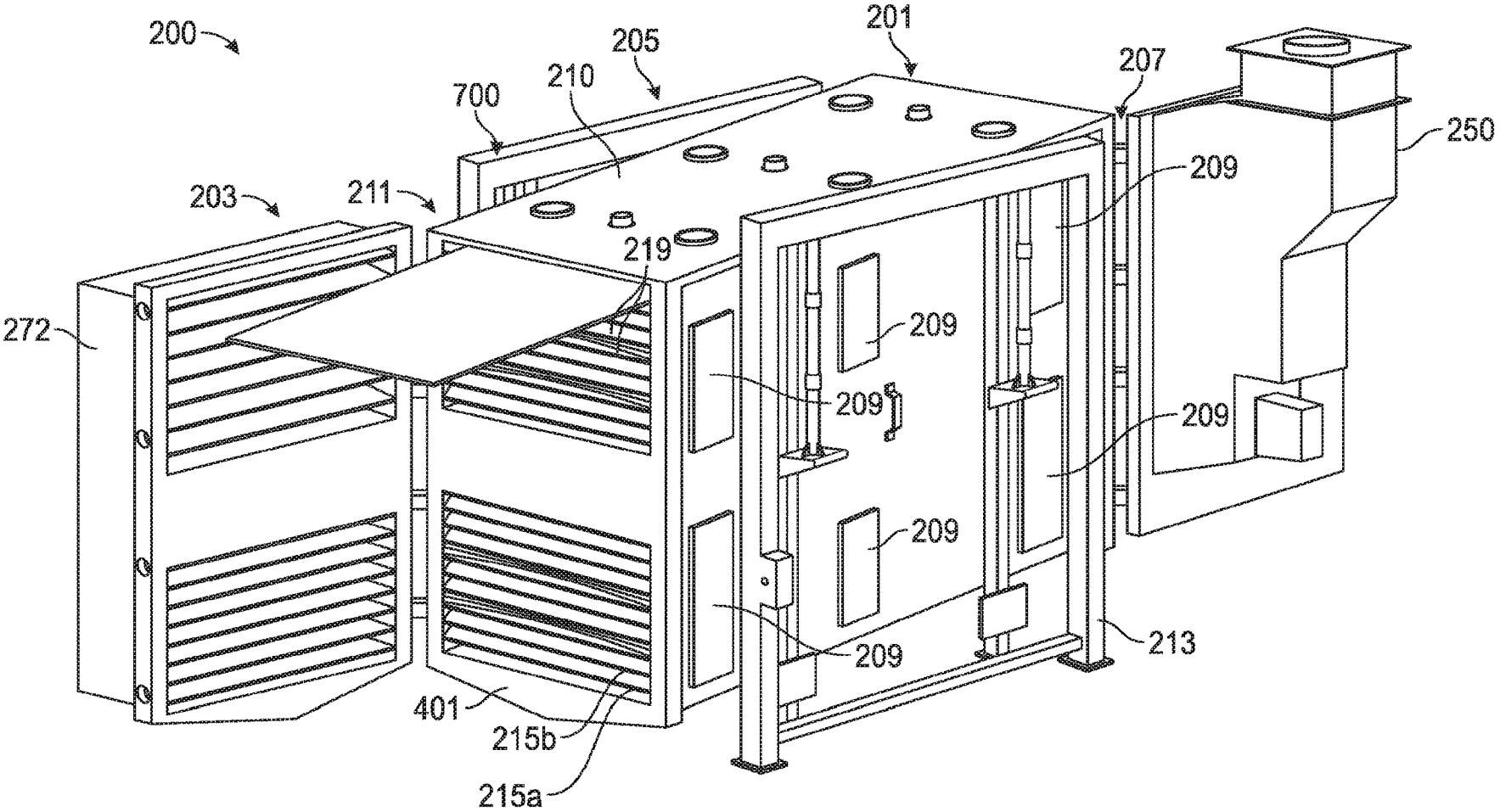
FIG. 4 shows a perspective view of a gyratory sifter according to embodiments of the present disclosure.
Figure 5:
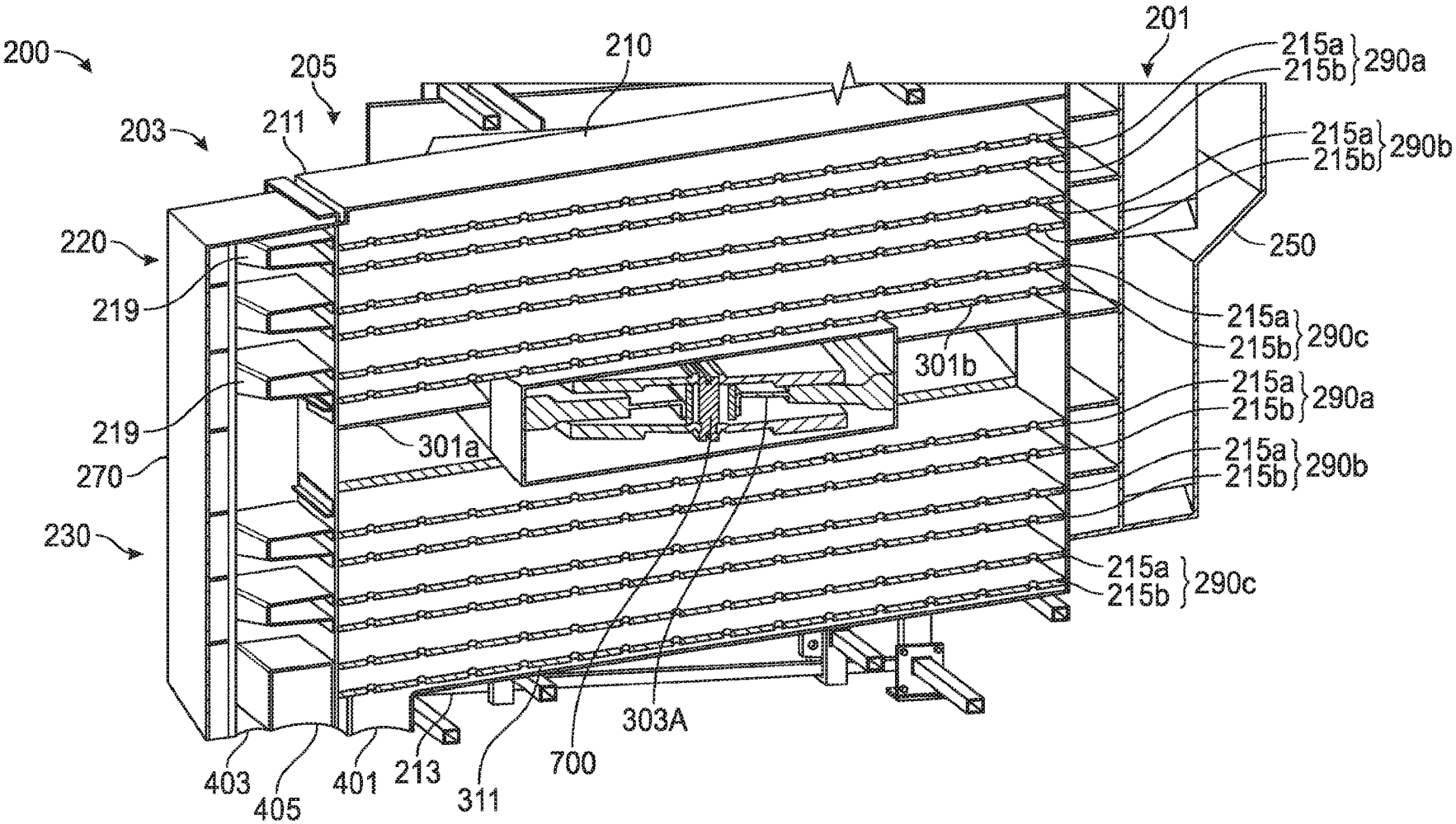
FIG. 5 shows a longitudinal cross-sectional view of a gyratory sifter according to embodiments of the present disclosure.

Referring to FIG. 4, in which a a perspective view of a gyratory sifter 200 in accordance with embodiments disclosed is shown, and FIG. 5, in which a cross-sectional view of the gyratory sifter 200 according to embodiments of the present disclosure is shown, the gyratory sifter 200 may include a screen basket coupled to a hanger system 700 that allows the screen basket to move in a horizontal plane. The gyratory sifter 200 includes a feed end 201, a discharge end 203 opposite the feed end 201, a first side 205 traversing from the feed end 201 to the discharge end 203, and a second side 207 side traversing from the feed end 201 to the discharge end 203 and opposite the first side 205. In some embodiments, the gyratory sifter 200 has a top cover 210. In some embodiments, the gyratory sifter 200 has a top portion 220 and a bottom portion 230. In some embodiments, the gyratory sifter 200 may include an inlet distributor 250 and a discharge distributor 270.

Both the top portion 220 and the bottom portion 230 may include three sets 290 of screening surfaces 215, each set having a first screening surface 215*a* and a second screening surface 215*b*. In some embodiments each screening surface 215 may include one or more screens and one or more ballboxes located beneath the screens and traversing the length of the gyratory sifter 200. As shown in FIG. 5, each screening surface 215 may include three separate screens and three separate ballboxes positioned side to side along a length of the sifter 200. Each screening surface 215 traverses the length of the gyratory sifter 200 from the feed end 201 to the discharge end 203. The gyratory sifter 200 may be declined downwards from the feed end 201 to the discharge end 203. One of ordinary skill in the art will appreciate that a sifter having any number of screens or sets of screens may be used in accordance with embodiments disclosed herein.

In some embodiments, an angled fines surface 219 may be located beneath a first set 290*a* and a second set 290*b* of screening surfaces 215. The angled fines surface 219 may include three separate angled fines pans 119 traversing the length of the gyratory sifter 200. One of ordinary skill in the art will appreciate that the number of angled fines pans 119 at a given level for below a given screen or set of screens may vary depending on the application or construction of a given sifter. Additionally, each angled fines pans 119 may include one or more side fines openings.

In some embodiments, the gyratory sifter 200 includes three side chutes 209 on both the first side 205 and the second side 207 in both the top section 220 and the bottom section 230. The side chutes 209 traverse vertically on both the first side 205 and the second side 207 in both the top section 220 and the bottom section 230 extending in a direction generally from the top end 211 to the bottom end 213. The location of the side chutes 209 on the gyratory sifter 200 may be aligned such that the first fines pan openings 129 and the second fines pan openings 131 of the three angled fines pans 219 beneath the first set 290*a* and the second set 290*b* of screening surfaces 215 align with the three side chutes 209.

Figure 7:
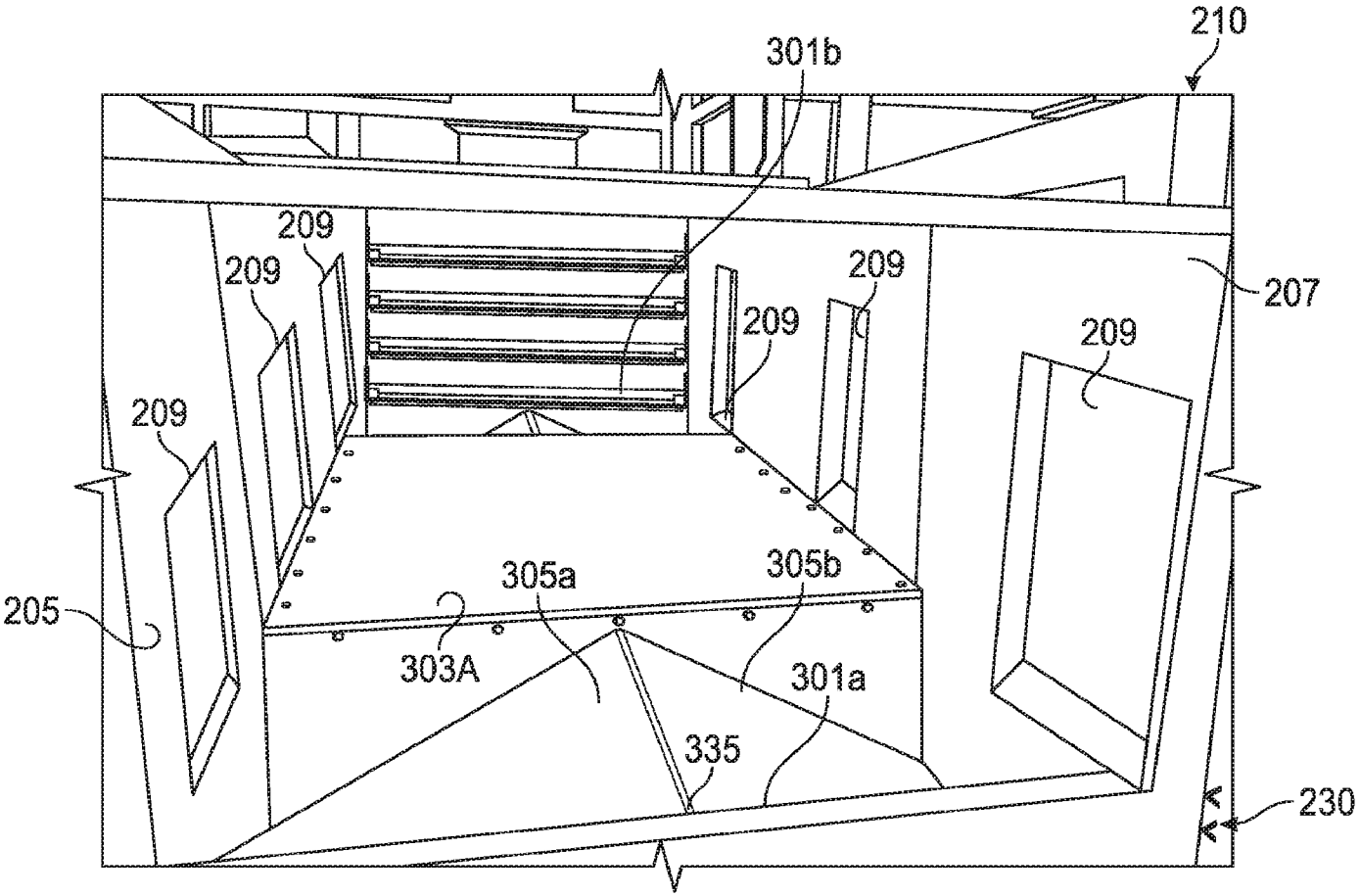
FIG. 7 shows an internal view of a top section view of the gyratory sifter of FIGS. 5 and 6 according to embodiments of the present disclosure.

Referring to FIG. 7, an internal view of a top section view of the gyratory sifter is shown with the screens, ballboxes, and fines pans removed. As shown in FIGS. 5 and 7, disposed between the top section 210 and the bottom section 230, a first angled discharge trough 301*a* may be located proximate the discharge end 203 and a second angled discharge trough 301*b* may be located proximate the feed end 201. The first and second angled discharge trough 301*a*, 301*b* may be located beneath a third set 290*c* of screening surfaces 215. The angled discharge troughs 301 may include a first surface 305*a* that traverses from the first side 205 upwards towards an apex 335 of the angled discharge trough 301. A second surface 305*b* may traverse from the second side 207 upwards towards the apex 335 of the angled discharge trough 301. A flat surface 303, which protects a motor 700, may be located between the first angled discharge trough 301*a* and the second angled discharge trough 301*b*. The angled discharge troughs 301 direct fines from the side chutes 209 of the top section 220 to the side chutes 209 of the bottom section 230. The motion of the gyratory sifter 200 will direct fines collected on the flat surface 303 to the first angled discharge trough 301*a* to be directed to the side chutes 209 of the bottom section 230.

In the bottom section 230, a bottom surface 311 is located beneath the third set 290*c* of screening surfaces 215. The bottom surface 311 includes a first surface (not shown) that may traverse from the first side 205 downwards towards a first discharge outlet 401 and a second surface (not shown) 305*b* may traverse from the second side 207 downwards towards the first discharge outlet 401.

Referring to FIGS. 3 and 5-7, when the gyratory sifter 200 is in operation, a source material is fed to the inlet distributor 250 and distributed to the first screening surfaces 215*a*. The sifter imparts a rapidly reciprocating motion to the gyratory sifter 200 and the screening surfaces 215. The source material generally flows toward the discharge end 103 of the basket assembly 100. Large particles that are unable to pass through the first screening surfaces 215*a* remain on top of the screen, and move toward the discharge end 203 of the basket assembly where they are discharged through discharge distributor 270 through a second discharge outlet 403. Smaller particles pass through the first screening surfaces 215*a* and are distributed across the second screening surfaces 215*b*. Particles that are unable to pass through the second screening surfaces 215*b* remain on top of the screen and move toward the discharge end 203 of the basket assembly where they are discharged through discharge distributor 270 through a third discharge outlet 405.

In the top section 210, smaller particles (fines) pass through the first set 290*a* and the second set 290*b* of screens 215 and collect in the angled fines pans 219 therebeneath. The reciprocating motion to the gyratory sifter 200 and the angled fines pans 219 move the fines towards the first fines pan opening 129 and the second fines pan opening 131. The fines leave the angled fines pans 219 and enter the corresponding side chutes 209 to be discharged to either the first angled discharge trough 301*a*, the second angled discharge trough 301*b* or the flat surface 303 to be discharged the side chutes 209 of the bottom section 230. In the bottom section 230, angled discharge troughs 301 direct fines from the side chutes 209 of the top section 220 to the side chutes 209 of the bottom section 230. The motion of the gyratory sifter 200 will direct fines from the flat surface 303 to the first angled discharge trough 301*a* to be directed to the side chutes 209 of the bottom section 230.

In the bottom section 230, smaller particles (fines) pass through the first set 290*a* and the second set 290*b* of screens 215 and collect in the angled fines pans 219 therebeneath. The reciprocating motion to the gyratory sifter 200 and the angled fines pans 219 move the fines towards the first fines pan opening 129 and the second fines pan opening 131. The fines leave the angled fines pans 219 and enter the corresponding side chutes 209 to be discharged to the bottom surface 311 and out the first discharge chute 401.

Contamination of the screens below the fines deck may be prevented by discharging the fines product from each deck to the side chutes. The side chutes may also simplify the door assembly by re-locating the discharge point of the fines from the door assembly to the basket assembly.

In accordance with one or more embodiments disclosed herein, an apparatus may include a first fines pan side traversing from a feed end to a discharge end, the first fines side having a first fines opening proximate the discharge end, a second fines pan side traversing from the feed end to the discharge end opposite the first fines side, the second fines side having a second fines opening proximate the discharge end, a first surface traversing from the first fines pan side upwards towards an apex of the fines pan, and a second surface traversing from the second fines pan side upwards towards the apex of the fines pan, the first fines pan side, the second fines pan side, the first surface, and the second surface forming a fines pan, as discussed above.

In accordance with one or more embodiments disclosed herein, an apparatus may include a system may include a basket assembly, at least one screen, at least one ballbox disposed below the least one screen, and at least one fines pan positioned beneath at least one ballbox. The basket assembly may include a feed end, a discharge end opposite the feed end, a first side traversing from the feed end to the discharge end, and a second side traversing from the feed end to the discharge end and opposite the first side. The basket assembly may also have at least one of the first side or the second side having at least one side chute extending in a direction from a top end to a bottom end of the at least one first side or the second side. The fines pan may include a first fines pan side traversing from the feed end to the discharge end and a second fines pan side traversing from the feed end to the discharge end opposite the first fines side. The first fines side may include a first fines opening proximate the discharge end. The second fines side may include a second fines opening proximate the discharge end. The first fines opening or the second fines opening may align with the at least one side chute of the basket assembly.

In accordance with one or more embodiments disclosed herein, a method may include depositing a fluid onto a plurality of screening surfaces in a sifter and imparting a motion to the sifter. The motion to the sifter may separate the fluid into a first sized solids and a second sizes solids with the plurality of screening surfaces, discharging the first sized solids from a discharge end of the sifter. The method may also include receiving the second size solid component onto a plurality of fines pans located beneath the plurality of screening surfaces and flowing the second sized solids from the plurality of fines pan to at least one side chute of the sifter through a side opening of the plurality of fines pan. The method may also include discharging the second size solid component from the at least one side chute out of the sifter.

Those of ordinary skill in the art will appreciate that the above description of angled fines pans, basket assemblies or gyratory shifter according to embodiments disclosed herein is merely illustrative. The embodiments described are not meant as a limitation on the scope of the present disclosure.

While the present disclosure has been described with respect to a limited number of embodiments, those skilled in the art, having benefit of the present disclosure will appreciate that other embodiments may be devised which do not depart from the scope of the disclosure described herein. Accordingly, the scope of the disclosure should be limited only by the claims appended hereto.

What is claimed is:

1. A system comprising:
- a basket assembly comprising:
- a feed end;
- a discharge end opposite the feed end;
- a first side traversing from the feed end to the discharge end; and
- a second side traversing from the feed end to the discharge end and opposite the first side,
- wherein at least one of the first side and the second side includes at least one side chute extending in a direction from a top end to a bottom end of the at least one of the first side and the second side;
- at least one screen;
- at least one ballbox, each ballbox disposed below a respective screen of the least one screen;
- a plurality of fines pans traversing a length of the basket assembly from the feed end to the discharge end, each fine pan of the plurality of fine pans positioned beneath a respective ballbox of the at least one ballbox and comprising:
  - a first fines pan side traversing from the feed end to the discharge end, the first fines pan side having a first fines opening proximate the discharge end;
  - a first surface traversing from the first fines pan side upwards towards an apex of the fines pan;
  - a second fines pan side traversing from the feed end to the discharge end opposite the first fines side, the second fines pan side having a second fines opening proximate the discharge end; and
  - a second surface traversing from the second fines pan side upwards towards the apex of the fines pan,
  - wherein at least one of the first fines opening and the second fines opening aligns with the at least one side chute of the basket assembly.

2. The system of claim 1, wherein the basket assembly angles downwards from the feed end to the discharge end.

3. The system of claim 1, wherein at least one fines pan of the plurality of fines pans is supported by a first spacer coupled to the first side and the second fines pan side is supported by a second spacer coupled to the second side.

4. The system of claim 1, wherein each first fines opening extends through a respective first fines pan side, and each second fines opening extends through a respective second fines pan side.

5. The system of claim 1, wherein the at least one side chute comprises an angled bottom surface.

6. The system of claim 1, wherein the at least one side chute is fluidly connected to a bottoms fines pan, the bottoms fines pan disposed beneath a lowermost ballbox located proximate a bottom surface of the basket assembly.

7. The system of claim 6, wherein the bottoms fines pan comprises a first surface traversing downwards from the first side to a discharge chute and a second surface traversing downwards from the second side to the discharge chute.

8. The system of claim 1, further comprising:

a plurality of side chutes on the first side spaced along the length of the basket assembly from the feed end to the discharge end;

a plurality of side chutes on the second side spaced the length of the basket assembly from the feed end to the discharge end;

wherein the first fines opening of each fines pan is proximate to one of the plurality of side chutes on the first side; and wherein the second fines opening of each fines pan is proximate to one of the plurality of side chutes on the second side.

9. The system of claim 1, wherein the apex is a lateral center of the fines pan.

10. The system of claim 1, wherein the at least one side chute is fluidly connected to at least one of a first angled discharge trough, a second angled discharge trough, or a flat bottoms surface.

11. The system of claim 10, wherein the first angled discharge trough or the second angled discharge trough comprises a first surface traversing from the first side upwards towards an apex and a second surface traversing from the second side upwards towards an apex of the angled discharge trough.

12. The system of claim 10, wherein the first angled discharge trough is proximate the discharge end and the second angled discharge trough is proximate the feed end.

13. The system of claim 12, wherein the flat bottoms surface is located between the first angled discharge trough and the second angled discharge trough.

14. A system comprising:

a basket assembly comprising:

a feed end;

a discharge end opposite the feed end;

a first side traversing from the feed end to the discharge end and including a plurality of side chutes spaced along the length of the basket assembly from the feed end to the discharge end; and a second side traversing from the feed end to the discharge end and opposite the first side and including a plurality of side chutes spaced along the length of the basket assembly from the feed end to the discharge end, wherein at least one side chute of at least one of the first side and the second side extends in a direction from a top end to a bottom end of the at least one of the first side and the second side;

at least one screen;

at least one ballbox, each ballbox disposed below a respective screen of the least one screen;

a plurality of fines pans traversing a length of the basket assembly from the feed end to the discharge end, each fine pan of the plurality of fine pans positioned beneath a respective ballbox of the at least one ballbox and comprising:

a first fines pan side traversing from the feed end to the discharge end, the first fines side having a first fines opening proximate the discharge end;

a second fines pan side traversing from the feed end to the discharge end opposite the first fines side, the second fines side having a second fines opening proximate the discharge end;

wherein the first fines opening of each fines pan is proximate to a respective one of the plurality of side chutes on the first side; and wherein the second fines opening of each fines pan is proximate to a respective one of the plurality of side chutes on the second side.

15. The system of claim 14, wherein the basket assembly angles downwards from the feed end to the discharge end.

16. The system of claim 14, wherein at least one fines pan of the plurality of fines pans is supported by a first spacer coupled to the first side and the second fines pan side is supported by a second spacer coupled to the second side.

17. The system of claim 14, wherein each first fines opening extends through a respective first fines pan side, and each second fines opening extends through a respective second fines pan side.

* * * * *